US005830115A

United States Patent [19]

Chen

[11] Patent Number: 5,830,115

[45] Date of Patent: Nov. 3, 1998

[54] MULTIPURPOSE EXERCISING APPARATUS

[76] Inventor: Wu Tsung Chen, 7, Lane 279, Hsi Men Road, Sec. 1, Tainan, Taiwan

[21] Appl. No.: 1,878

[22] Filed: Dec. 31, 1997

[51] Int. Cl.[6] ..... A63B 21/00

[52] U.S. Cl. ..... 482/96; 482/95; 482/142

[58] Field of Search ..... 482/142, 72, 95, 482/96, 90, 57, 106, 110, 111, 130

[56] References Cited

U.S. PATENT DOCUMENTS

| | | | |
|---|---|---|---|
| 5,069,447 | 12/1991 | Snyderman et al. | 482/142 |
| 5,429,568 | 7/1995 | Chen | 482/96 |
| 5,527,249 | 6/1996 | Harris | 482/96 |
| 5,531,658 | 7/1996 | L. S. C. | 482/142 |
| 5,580,340 | 12/1996 | Yu | 482/96 |
| 5,616,106 | 4/1997 | Abelbeck | 482/130 |
| 5,658,225 | 8/1997 | Huang | 482/96 |
| 5,669,865 | 9/1997 | Gordon | 482/96 |

*Primary Examiner*—Jerome W. Donnelly

*Attorney, Agent, or Firm*—Pro-Techtor International Services

[57] ABSTRACT

A multipurpose exercising apparatus which includes bench pivoted to an upright of a base frame, a support frame raised from the base frame, the support frame having a downwardly extended oscillating bar, a cross bar intersected with the oscillating bar, two smoothly arched actuating bars pivoted to the oscillating bar at two opposite sides, and two guard plates respectively fastened to the actuating bars at an outer side, each guard plate having a smoothly curved sliding slot which receives the cross bar on the oscillating bar, and a driving handle unit connected to two opposite ends of the cross bar for turning by hand to oscillate the oscillating bar, causing the smoothly arched actuating bars to lift and lower the free end of the bench.

5 Claims, 10 Drawing Sheets

MULTIPURPOSE EXERCISING APPARATUS

BACKGROUND OF THE INVENTION

The present invention relates to exercising apparatus, and more particularly to a multipurpose exercising apparatus that can be used as a push-up exerciser, a trunk-bending exerciser, as well as a weight-lifting exerciser.

A variety of exercising apparatus have been developed for different exercising purposes, and have appeared on the market. These exercising apparatus are commonly designed for a specific exercising purpose. There are also known universal exercise units that provide multiple functions for different exercising purposes. However, these multipurpose exercising apparatus are commonly heavy, complicated, and expensive.

SUMMARY OF THE INVENTION

The present invention has been accomplished to provide a multipurpose exercising apparatus which is simple and inexpensive to manufacture. According to one aspect of the present invention, the multipurpose exercising apparatus comprises a bench pivoted to an upright of a base frame, a support frame raised from the base frame, the support frame having a downwardly extended oscillating bar, a cross bar intersected with the oscillating bar, two smoothly arched actuating bars pivoted to the oscillating bar at two opposite sides, and two guard plates respectively fastened to the actuating bars at an outer side, each guard plate having a smoothly curved sliding slot which receives the cross bar on the oscillating bar, and a driving handle unit connected to two opposite ends of the cross bar for turning by hand to oscillate the oscillating bar, causing the smoothly arched actuating bars to lift and lower the free end of the bench. According to another aspect of the present invention, the driving handle unit is comprised of two retractable driving bars that can be respectively adjusted to the desired length. According to still another aspect of the present invention, the retractable driving bars are respectively connected to the end cups of the cross bar by a respective locking lever-controlled ratchet connector, so that the angular position of the retractable driving bars can be adjusted relative to the cross bar when the locking lever at each ratchet connector is unlocked.

DETAILED DESCRIPTION OF THE PREFERRED EMBODIMENT

Figure 1:
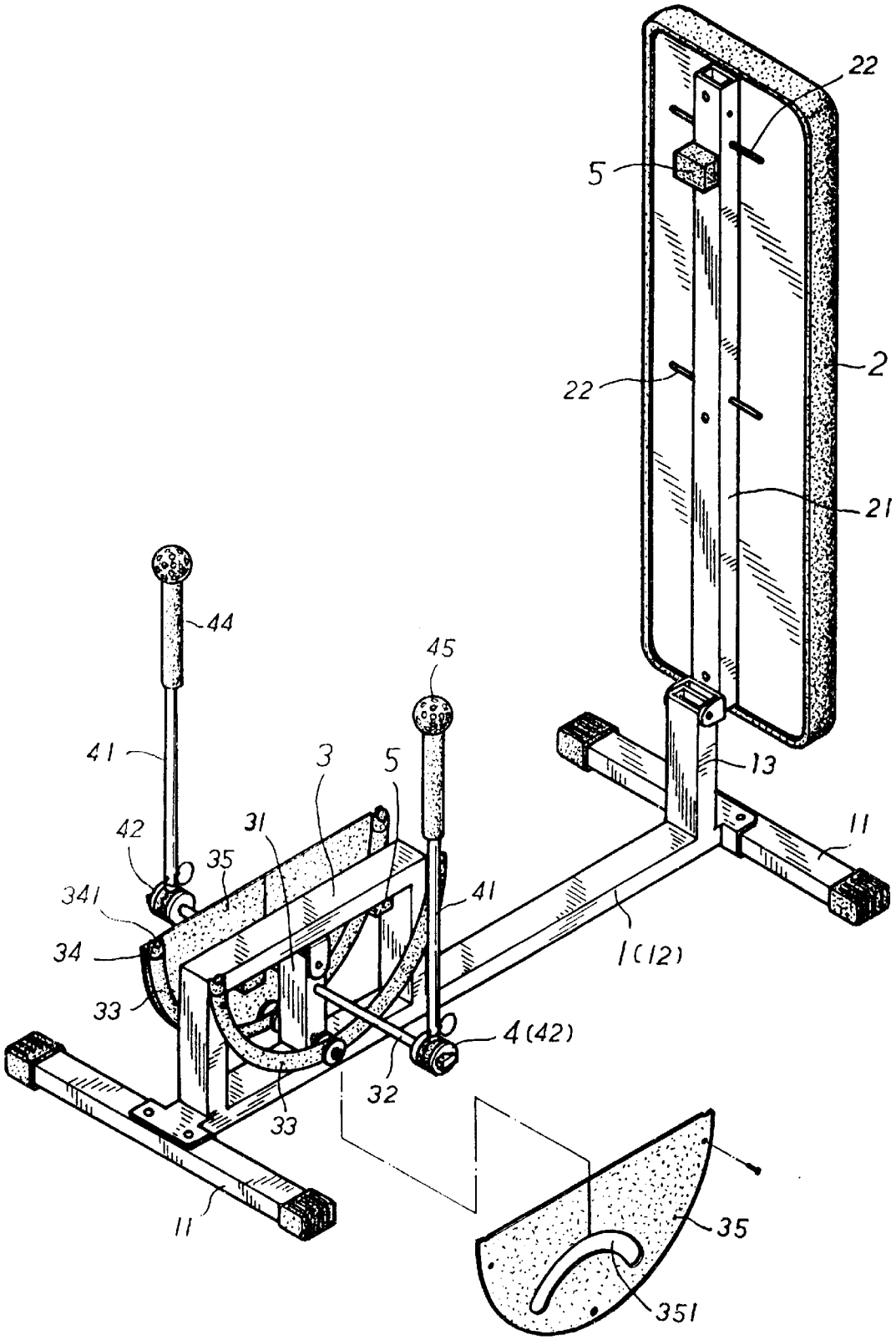
FIG. 1 is a perspective and partially exploded view of a multipurpose exercising apparatus according to the present invention.
Figure 2:
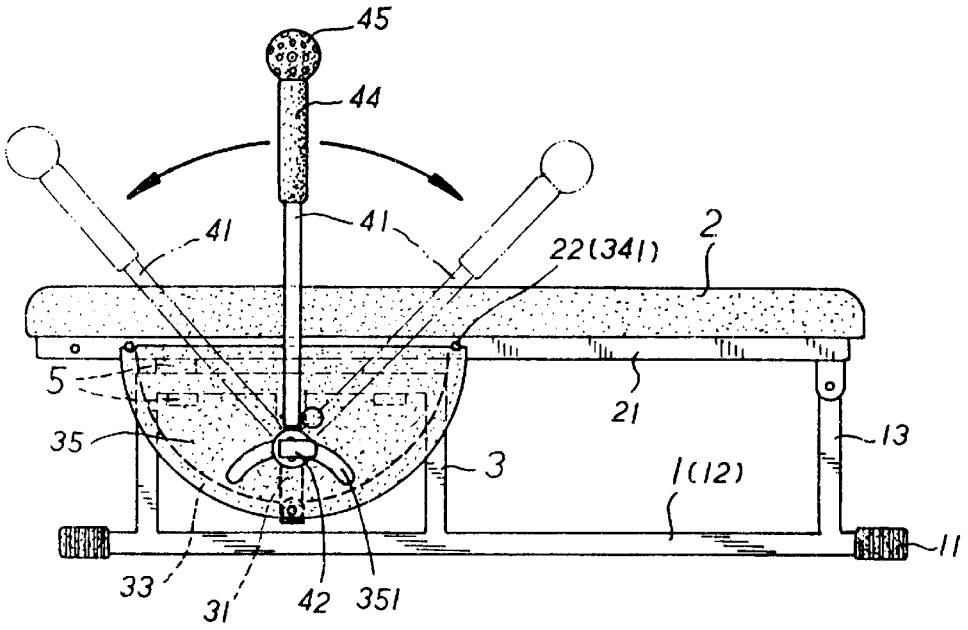
FIG. 2 is a side view of the present invention, showing the angular position of the driving handle unit adjusted.

Referring to FIGS. 1 and 2, a multipurpose exercising apparatus in accordance with the present invention is generally comprised of a base frame 1, a bench 2, a support frame 3, and a driving handle unit 4.

Figure 3:
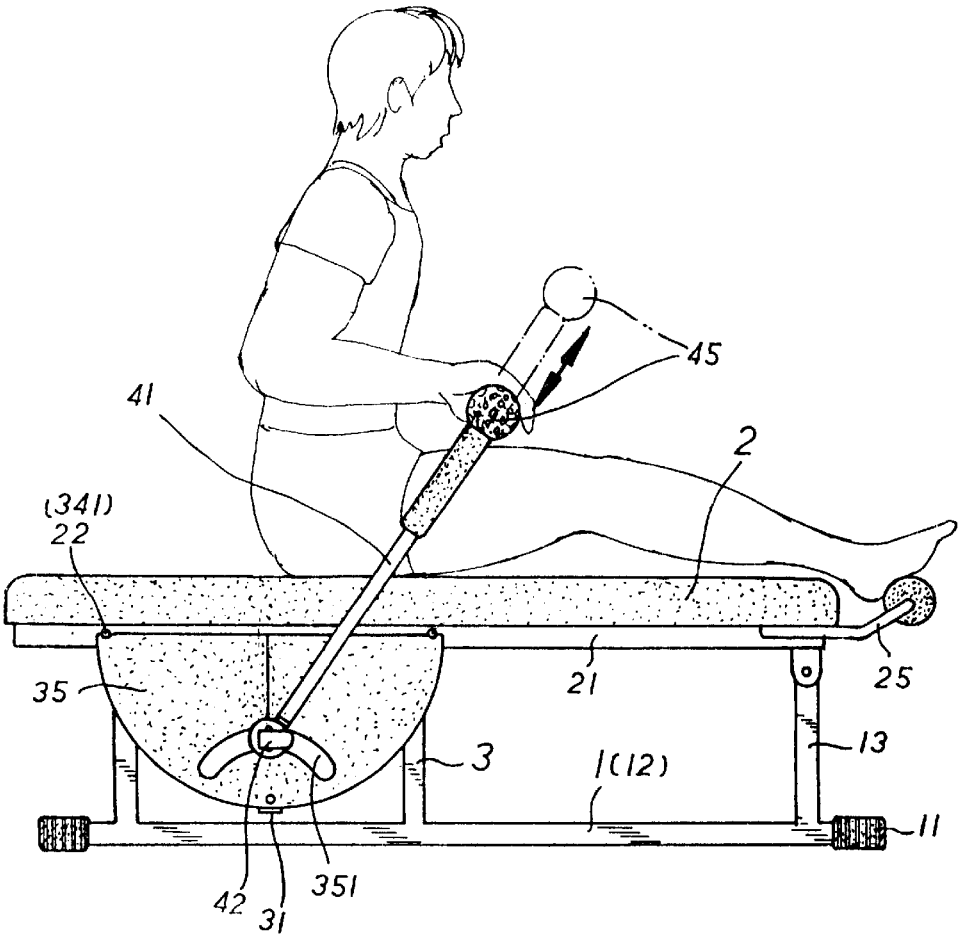
FIG. 3 is another side view of the present invention, showing the length of the driving bars adjusted.
Figure 4:
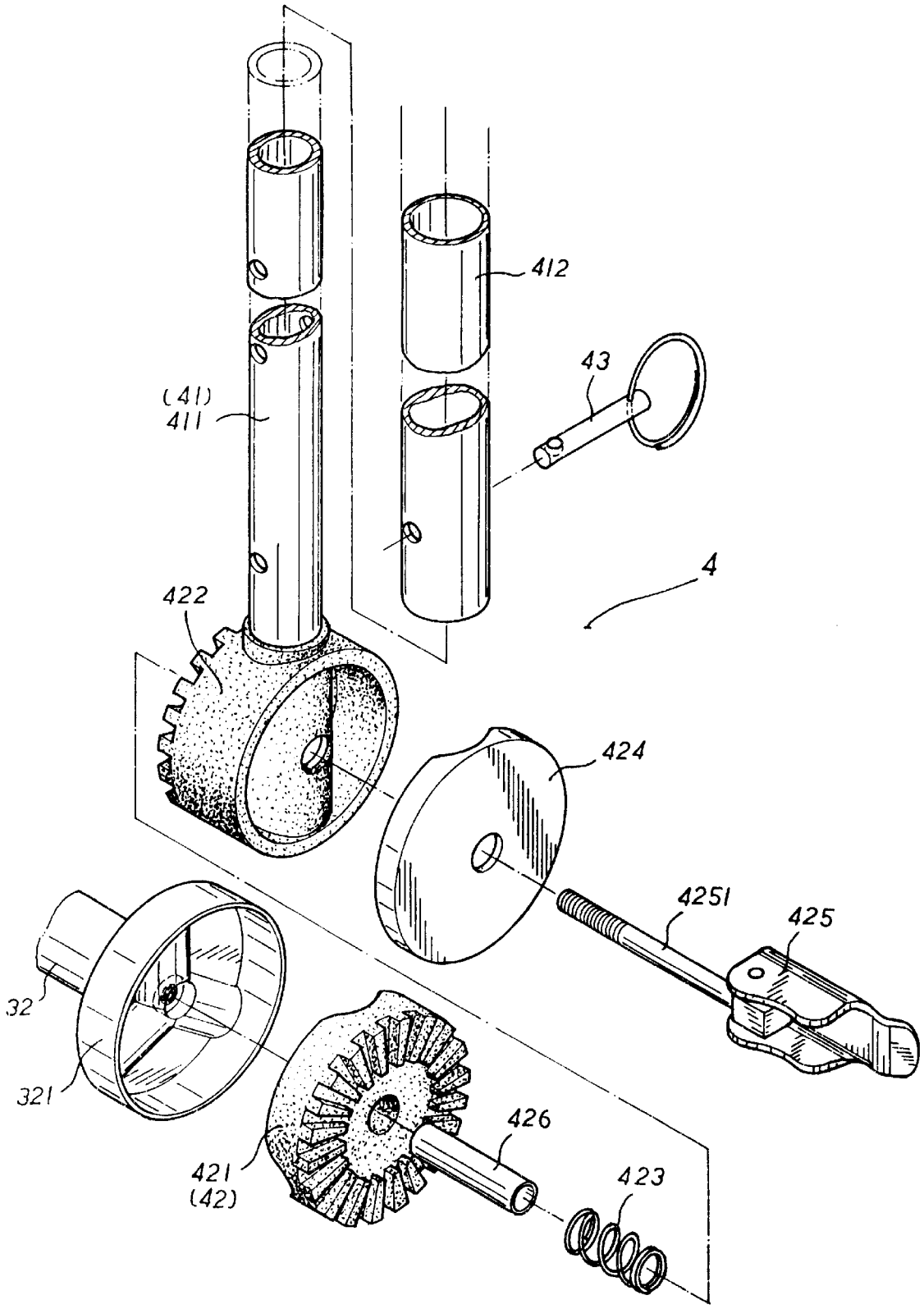
FIG. 4 is an exploded view in an enlarged scale of a ratchet connector according to the present invention.

Referring to FIGS. 3 and 4 and FIGS. 1 and 2 again, the base frame 1 comprises two transverse bars 11, a longitudinal main shaft 12 connected between the transverse bars 11, and an upright 13 raised from one end of the longitudinal main shaft 12. The bench 2 comprises a longitudinal bottom frame 21 having one end pivoted to the upright 13, and two transverse locating rods 22 intersected with the longitudinal bottom frame 21. The support frame 3 is fixedly mounted on the main shaft 12 remote from the upright 13. An oscillating bar 31 is provided having a top end pivoted to the transverse top of the support frame 3. A cross bar 32 is intersected with the oscillating bar 31, having two end cups 321 spaced from the oscillating bar 31 at two opposite sides (see also FIG. 4). Two smoothly arched actuating bars 33 are bilaterally pivoted to the oscillating bar, and turned about an axis. Two locating blocks 34 are provided at two opposite ends of each smoothly arched actuating bar 33. Each locating block 34 has a locating groove 341. When the bench 2 is turned to the operative position as shown in FIGS. 2 and 3, the transverse locating rods 22 of the bench 2 are respectively forced into engagement with the locating grooves 341 on the locating blocks 34 at two opposite ends of each smoothly arched actuating bar 33. Two guard plates 35 are respectively fastened to the smoothly arched actuating bars 33 at an outer side. Each guard plate 35 has a smoothly curved sliding slot 351, which receives the cross bar 32.

Referring to FIGS. from 4 to 6 and FIG. 1 again, the driving handle unit 4 comprises a pair of driving bars 41, and a pair of ratchet connectors 42 respectively mounted on the driving bars 41 at one end and connected to the end cups 321 of the cross bar 32. Each driving bar 41 is comprised of an inner tube 411, and an outer tube 412 sleeved onto the inner tube 411 and secured thereto by a locating pin 43. The inner tube 411 and the outer tube 412 have a respective row of longitudinally spaced locating holes, so that the outer tube 412 can be longitudinally moved relative to the inner tube 411 and then fixed to the inner tube 411 at the desired location by the locating pin 43, i.e., the total length of the driving bar 41 is adjustable. The outer tube 412 is covered with a soft covering 44, having a top end terminating in a rounded knob 45 (see FIG. 1). The ratchet connector 42 comprises a first ratchet wheel 421, a second ratchet wheel 422, a compression spring 423, a tube 426, a locking lever 425, and a shaft 4251. The shaft 4251 is fixedly fastened to the center of one end cup 421 and longitudinally aligned with the cross bar 32. The tube 426 is sleeved onto the shaft 4251, and retained between the end cup 421 and the cap 424. The first ratchet wheel 421 is fixedly mounted within the end cup 321 around the tube 426 at one end of the cross bar 32.

Figure 5:
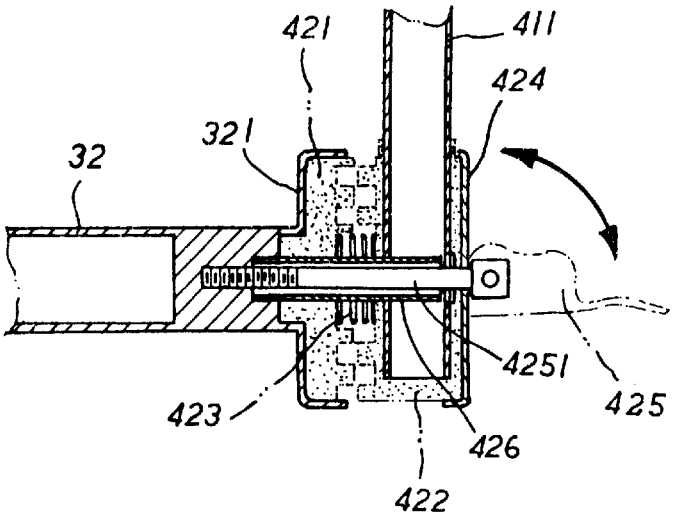
FIG. 5 is a sectional view of the ratchet connector according to the present invention, showing the locking lever turned to the unlocking position.
Figure 6:
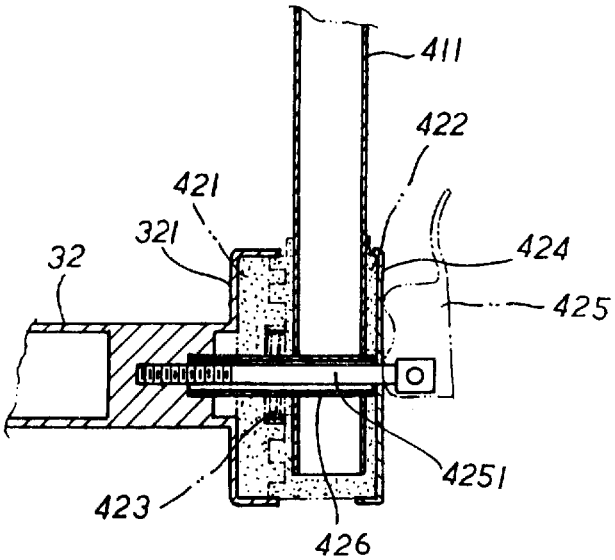
FIG. 6 is similar to FIG. 5 but showing the locking lever turned to the locking position.

The second ratchet wheel 422 is fixedly connected to one end of the inner tube 411, and revolvably mounted around the tube 426. The compression spring 423 is mounted around the tube 426, and connected between the first ratchet wheel 421 and the second ratchet wheel 422. The end cap 424 is covered on the second ratchet wheel 422 at an outer side around the shaft 4251. The locking lever 425 is pivoted to one end of the shaft 4251 remote from the end cup 321 at one end of the cross bar 32, and disposed outside the cap 424. The locking lever 425 can be turned between the locking position, as shown in FIG. 6, where the compression spring 423 is compressed and the second ratchet wheel 422 is forced into engagement with the first ratchet wheel 421 to prohibit the driving bar 41 from being turned relative to the cross bar 32, and the unlocking position, as shown in FIG. 5, where the compression spring 423 is released and the second ratchet wheel 422 is disengaged from the first ratchet wheel 421 for permitting the driving bar 41 to be adjusted to the desired angular position relative to the cross bar 32 (see FIG. 2).

Figure 7:
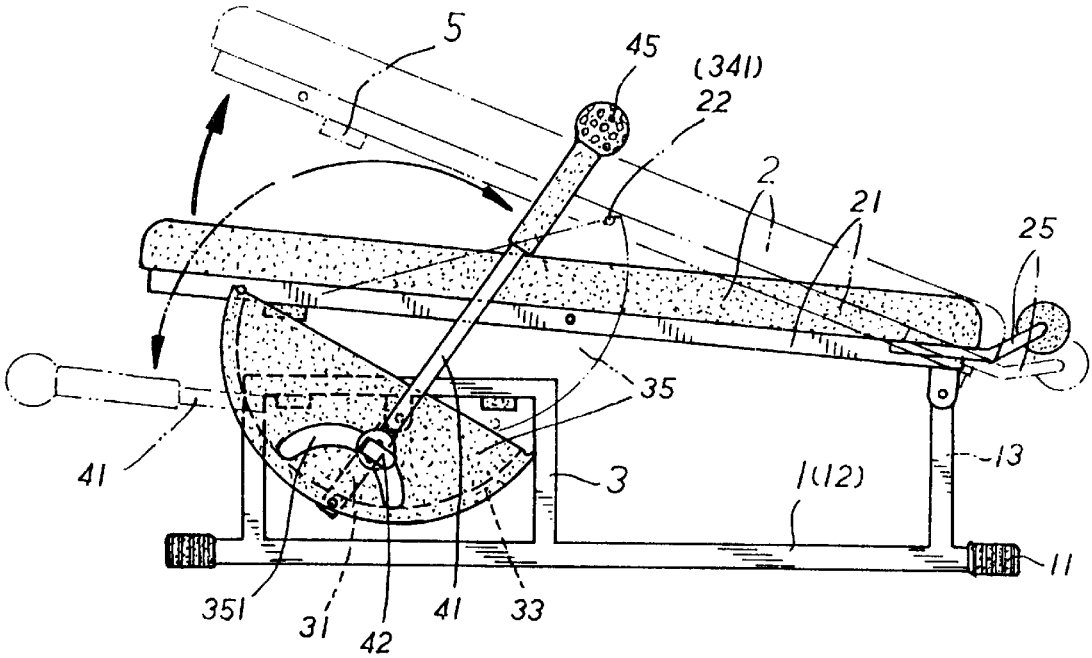
FIG. 7 is a schematic drawing showing the operation of the present invention.
Figure 9:
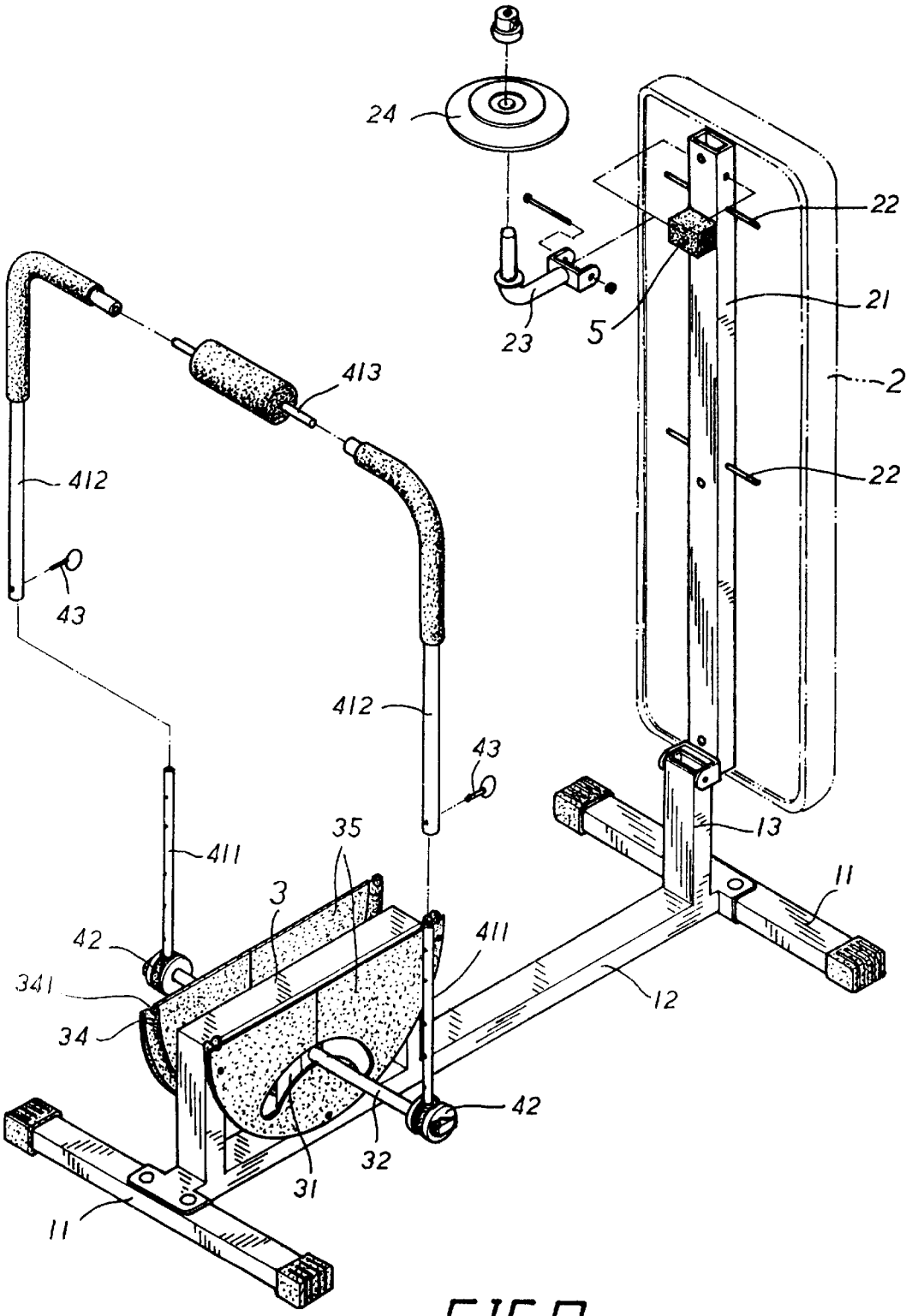
FIG. 9 is an exploded view of an alternate form of the present invention.

Referring to FIGS. 7 and 9 and FIG. 3 again, when the bench 2 is put in the operative position with the transverse locating rods 22 respectively forced into engagement with the locating grooves 341 on the locating blocks 34 at two opposite ends of each smoothly arched actuating bar 33, the user can then sit on the bench 2 and turn the driving bars 41 back and forth. When turning the driving bars 41 with the hands, the user can bend the truck. When the driving bars 41 are turned back and forth, the smoothly arched actuating bars 33 are turned about an axis to lift and lower the bench 2 alternatively.

Figure 11:
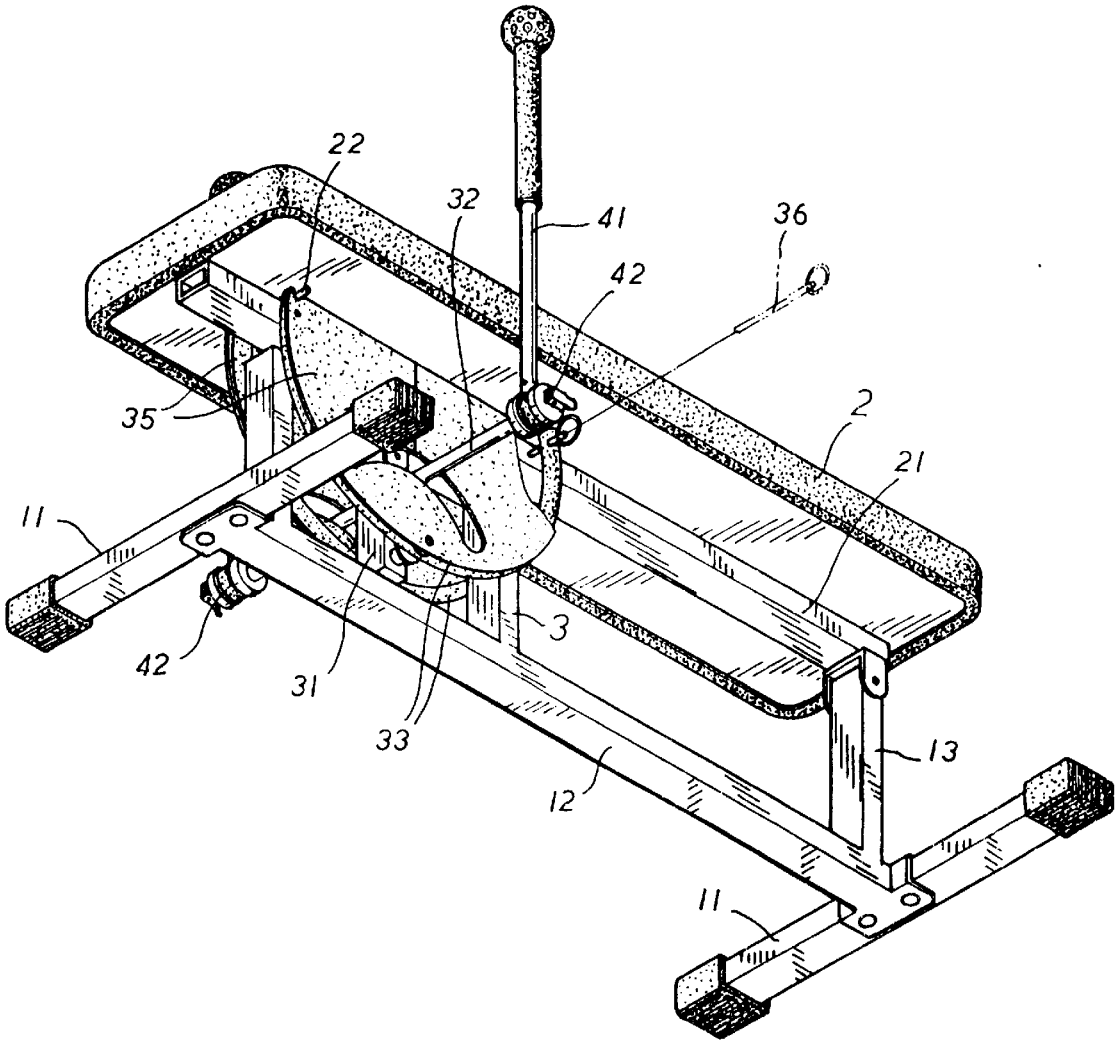
FIG. 11 is similar to FIG. 10 but showing the installation of a pin in the smoothly arched actuating bars and the longitudinal bottom frame of the bench.
Figure 12:
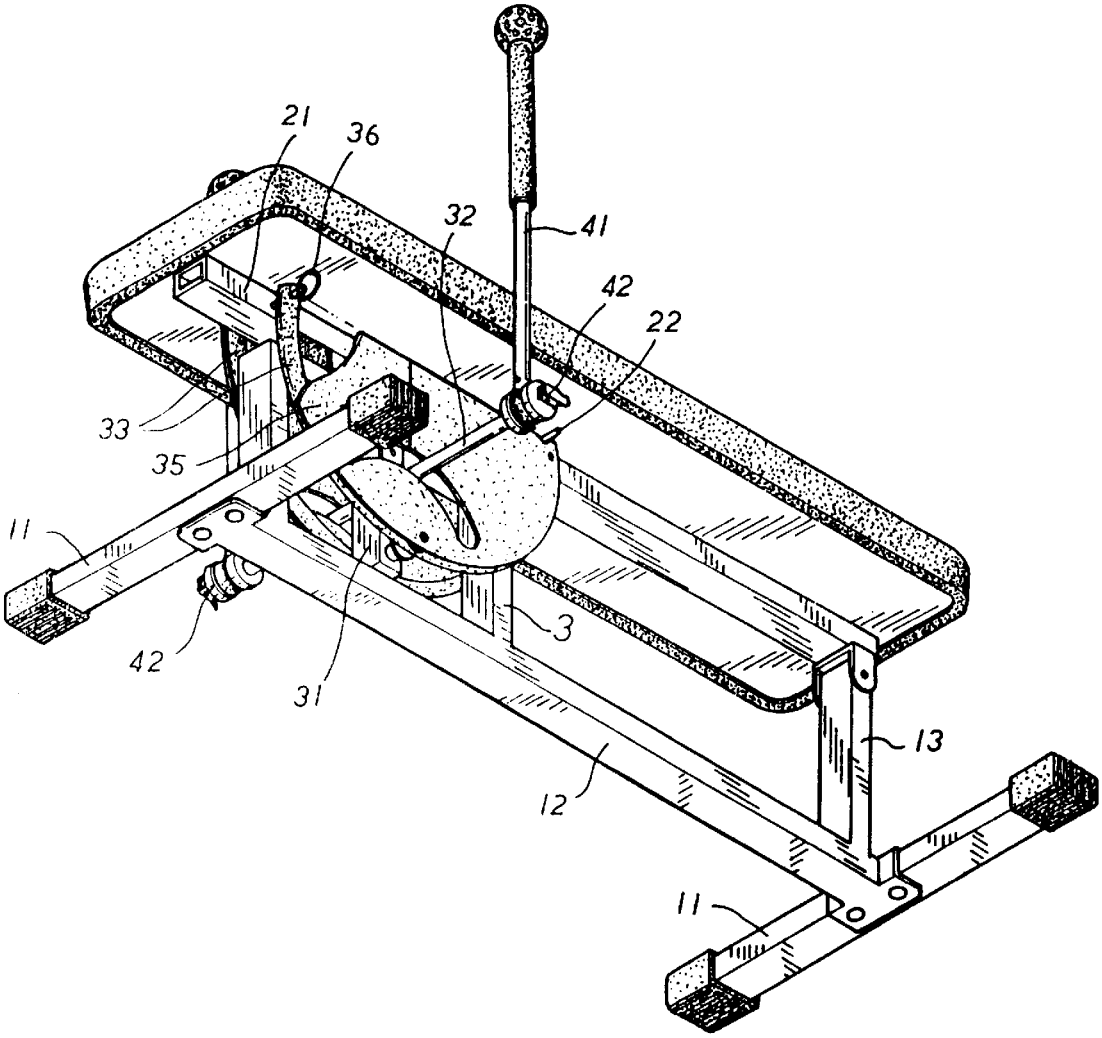
FIG. 12 is an assembly view of FIG. 11.

Referring to FIGS. 11 and 12, a pin 36 may be fastened to the smoothly arched actuating bars 33 and the longitudinal bottom frame 21 of the bench 2 at one end to limit the turning angle of the smoothly arched actuating bars 33.

Figure 10:
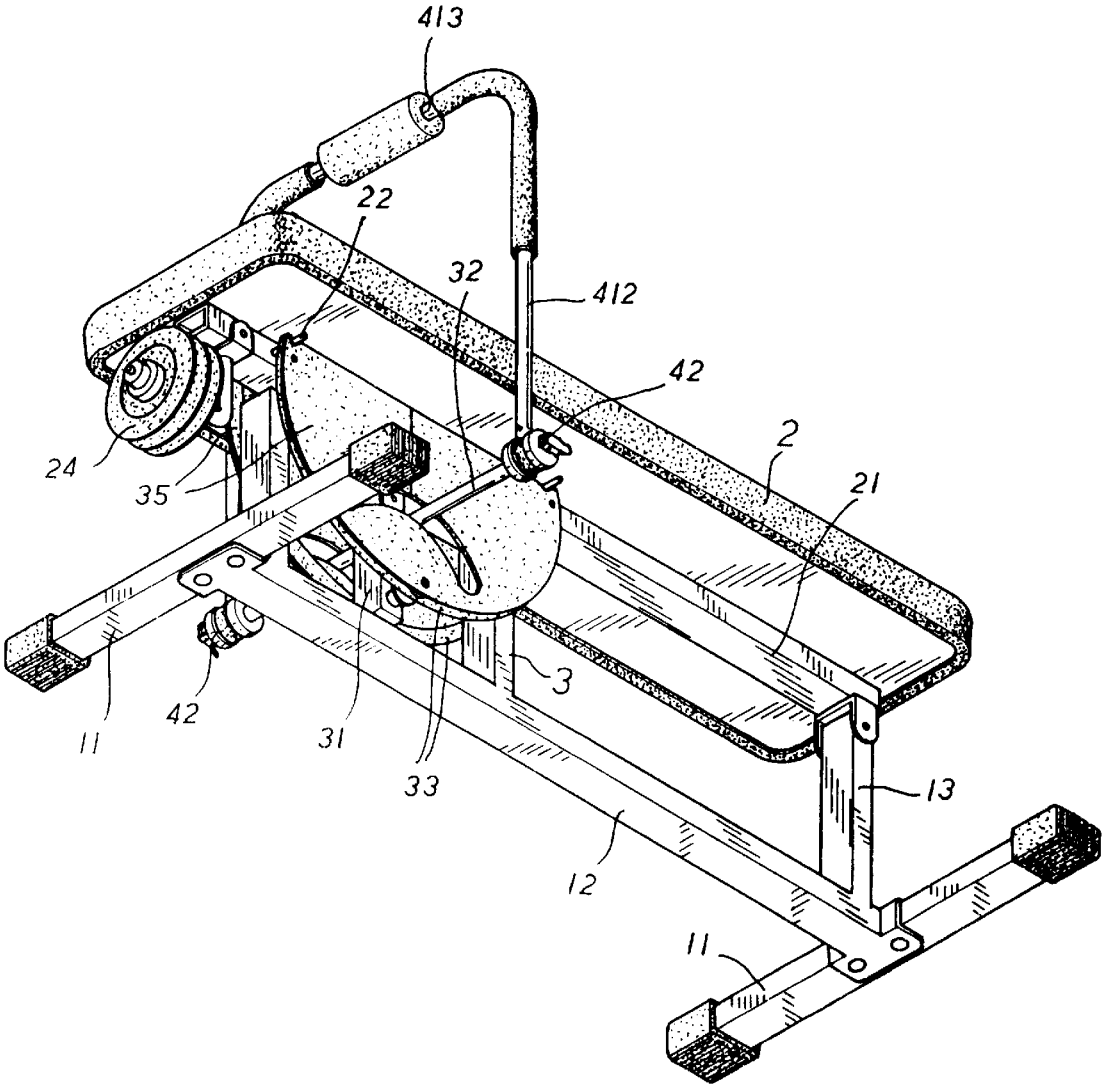
FIG. 10 is an oblique bottom view showing the alternate form of FIG. 9 assembled.

Referring to FIGS. 9 and 10, a weight holder 23 may be fixedly fastened to one end of the longitudinal bottom frame 21 remote from the upright right 13 to hold at least one weight 24.

Figure 8:
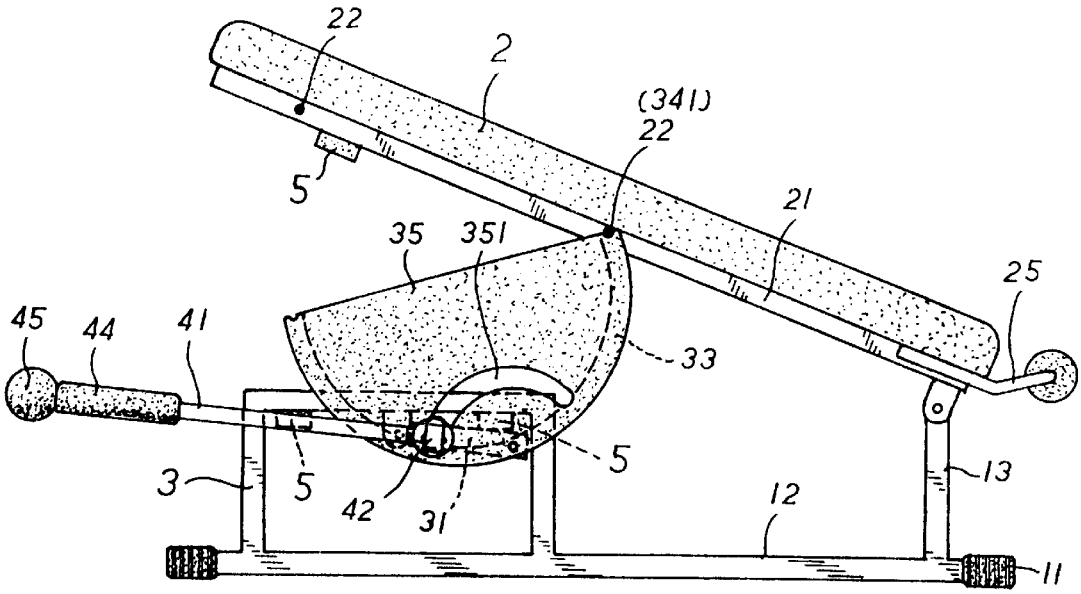
FIG. 8 is a side view of the present invention showing the driving bars lowered, the bench lifted.

Referring to FIGS. 3, 7 and 8 again, a foot bracket 25 is provided at the pivoted end of the bench 2 for the resting of the player's feet when the player sits on the bench and turning the driving bars 41.

Referring to FIGS. 1 and 8 again, cushion pads 5 are provided at the longitudinal bottom frame 21 of the bench 2 and the bottom side of the top of the support frame 3 to absorb impact.

Referring to FIGS. 9 and 10, the outer tubes 412 of the driving bars 41 may be connected together by a transverse connecting bar 413 to form a substantially U-shaped handle.

Figure 13:
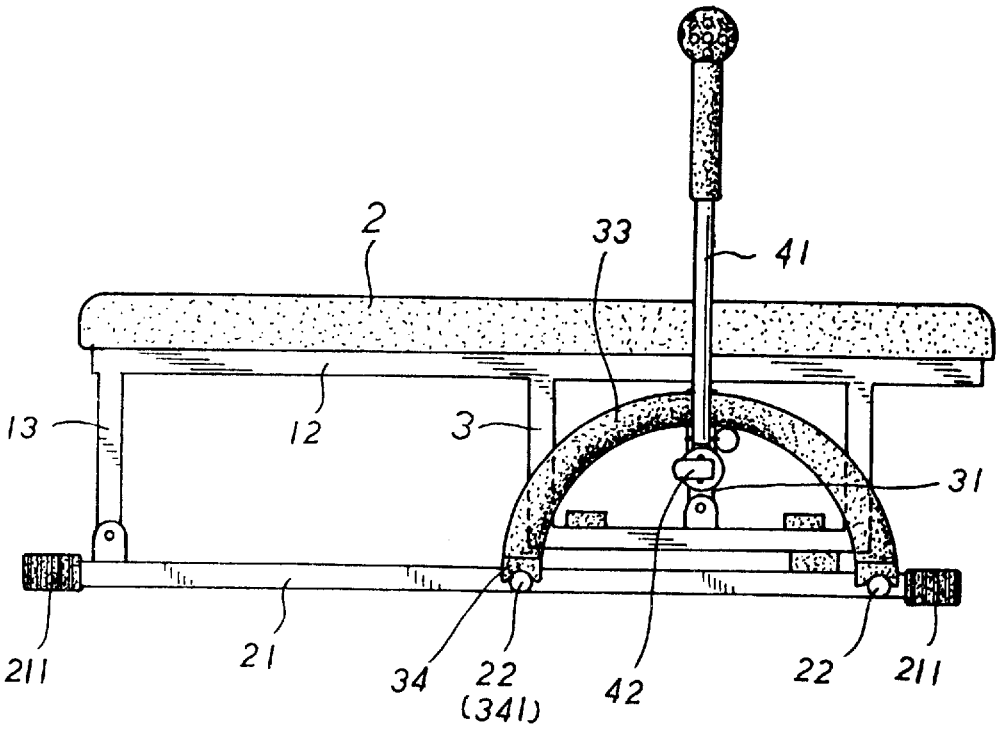
FIG. 13 is a side view of another alternate form of the present invention, showing the bench supported on the longitudinal main shaft of the base frame.

FIG. 13 shows an alternate form of the multipurpose exercising apparatus, in which the whole frame structure of the multipurpose exercising apparatus is turned upside down; the bench 2 is supported on the main shaft 12; two transverse frames 211 are respectively connected to the two opposite ends of the longitudinal bottom frame 21 for supporting the multipurpose exercising apparatus on the floor.

As indicated above, the present invention provides a multipurpose exercising apparatus that can be used as a rowing machine, a push-up exerciser, a trunk-bending exerciser, as well as a weight-lifting exerciser, etc. It is to be understood that the drawings are designed for purposes of illustration only, and are not intended as a definition of the limits and scope of the invention disclosed.

What the invention claimed is:

1. A multipurpose exercising apparatus comprising:

a base frame, said base frame comprising two transverse bars, a longitudinal main shaft connected between said transverse bars, and an upright raised from one end of said longitudinal main shaft;

a bench pivoted to the upright of said base frame and turned between a vertical position in vertical alignment with the upright of said base frame and a horizontal position perpendicular to the upright of said base frame, said bench comprising a longitudinal bottom frame having one end pivoted to the upright of said base frame;

a support frame unit fixedly mounted on said longitudinal main shaft remote from the upright of said base frame and adapted for supporting bench in said horizontal position; and a driving handle unit coupled to said support frame for turning with the hands when the free end of said bench is supported on said support frame and the user sits on said bench;

wherein said bench comprises two transverse locating rods intersected with the longitudinal bottom frame thereof;

said support frame unit comprises an oscillating bar pivoted to a transverse top thereof and holding a cross bar, said cross bar having two end cups spaced from said oscillating bar at two opposite sides, two smoothly arched actuating bars bilaterally pivoted to said oscillating bar and turned about a pivot on said oscillating bar, each of said smoothly arched actuating bars having two locating blocks at two opposite ends, said locating blocks having a respective locating groove which is respectively forced into engagement with the transverse locating rods on the longitudinal bottom frame of said bench when said bench is turned to a horizontal position;

said driving handle unit comprises two retractable handles, and two ratchet connectors respectively connected between said retractable handles and the end cups of the cross bar on said oscillating bar for permitting said smoothly arched actuating bars to be oscillated with said oscillating bar when said retractable handles are turned with the hands by the user to move said oscillating bar through said cross bar.

2. The multipurpose exercising apparatus of claim 1, wherein said smoothly arched actuating bars have one end respectively pivoted to the longitudinal bottom frame of said bench by a pivot pin.

3. The multipurpose exercising apparatus of claim 1, wherein two guard plates are respectively fastened to said smoothly arched actuating bars at an outer side, each of said guard plates having a smoothly curved sliding slot, which receives the cross bar on said oscillating bar.

4. The multipurpose exercising apparatus of claim 1, wherein a weight holder is provided at one end of said bench remote from the upright of said base frame to hold at least one weight.

5. The multipurpose exercising apparatus of claim 1, wherein two transverse frames are respectively connected to two opposite ends of said longitudinal bottom frame for supporting the multipurpose exercising apparatus on the floor when the whole assembly of the multipurpose exercising apparatus is turned upside-down, and said bench is disconnected from the upright of said base frame and supported on the longitudinal main shaft of said base frame.

* * * * *